US009247858B2

(12) United States Patent
Goodyear et al.

(10) Patent No.: US 9,247,858 B2
(45) Date of Patent: Feb. 2, 2016

(54) FLUID INLET FOR A DISHWASHER

(75) Inventors: Charles A. Goodyear, Kinston, NC (US); Mario Ascander Colon, Raleigh, NC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 309 days.

(21) Appl. No.: 13/517,827

(22) Filed: Jun. 14, 2012

(65) Prior Publication Data

US 2012/0247521 A1 Oct. 4, 2012

Related U.S. Application Data

(62) Division of application No. 12/362,262, filed on Jan. 29, 2009, now Pat. No. 8,201,569.

(51) Int. Cl.

| | |
|---|---|
| ***A47L 15/16*** | (2006.01) |
| ***A47L 15/42*** | (2006.01) |
| ***A47L 15/48*** | (2006.01) |

(52) U.S. Cl.

CPC ..... *A47L 15/4255* (2013.01); *A47L 15/16* (2013.01); *A47L 15/4217* (2013.01); *A47L 15/4246* (2013.01); *A47L 15/483* (2013.01); *A47L 15/488* (2013.01)

(58) Field of Classification Search

USPC ..... 134/56 D, 57 D, 58 D, 198

See application file for complete search history.

(56) References Cited

U.S. PATENT DOCUMENTS

| | | | | |
|---|---|---|---|---|
| 530,868 | A * | 12/1894 | Weed | 239/559 |
| 3,347,250 | A | 10/1967 | Martiniak | |
| 3,439,688 | A | 4/1969 | Sholtes | |
| 3,603,512 | A * | 9/1971 | Ham | 239/504 |
| 3,717,168 | A * | 2/1973 | Yake | 137/216.1 |
| 3,821,961 | A | 7/1974 | Schimke | |
| 4,365,758 | A * | 12/1982 | Schaming | 239/590 |
| 4,637,552 | A * | 1/1987 | Finkbeiner et al. | 239/428.5 |
| 4,657,036 | A | 4/1987 | Yake | |
| 5,251,939 | A | 10/1993 | Jordan | |
| 5,487,528 | A | 1/1996 | Richmond | |
| 5,650,599 | A * | 7/1997 | Madden et al. | 181/218 |
| 5,704,380 | A | 1/1998 | Zelniker et al. | |
| 5,878,603 | A | 3/1999 | Warren, Jr. et al. | |
| 5,899,433 | A | 5/1999 | Kim et al. | |
| 6,349,731 | B1 | 2/2002 | Schaaf et al. | |
| 6,378,542 | B1 | 4/2002 | DuHack | |
| 8,201,569 | B2 | 6/2012 | Goodyear et al. | |
| 2007/0151584 | A1 | 7/2007 | Omachi et al. | |

FOREIGN PATENT DOCUMENTS

| | | | | |
|---|---|---|---|---|
| DE | 2347253 | A | 3/1975 | |
| DE | 2525007 | A * | 12/1976 | |
| JP | 04297216 | A * | 10/1992 | A47L 15/20 |

* cited by examiner

*Primary Examiner* — David Cormier

(74) *Attorney, Agent, or Firm* — Alston & Bird LLP

(57) ABSTRACT

A fluid inlet for a dishwasher configured to help manage acoustic emissions is provided. The fluid inlet includes a nozzle that defines a first plurality of orifices and a second plurality of orifices having a larger diameter than the first plurality of orifices. The first or second plurality of orifices may define a diverging cross-section. The first plurality of orifices may be interspersed in a plurality of clusters between the second plurality of orifices. The fluid inlet may further include an enclosure defining a vertically descending channel from the nozzle toward a bottom of a tub of the dishwasher and one or more dampers within the enclosure such that the water exiting the nozzle cascades down onto and over the dampers and out of the enclosures through one or more outlets of the enclosure to the bottom of the tub.

21 Claims, 10 Drawing Sheets

FLUID INLET FOR A DISHWASHER

CROSS-REFERENCE TO RELATED APPLICATIONS

The present application is a divisional application of U.S. Pat. No. 8,201,569 filed on Jan. 29, 2009, which is hereby incorporated by reference in its entirety herein.

BACKGROUND

The present invention generally relates to dishwashers and, more particularly, to vents and valves for filling and emptying dishwashers with water and air or other fluids and gases.

One issue of interest in the field of dishwashers is to reduce the externally perceptible noise generated by a dishwasher when the dishwasher is in use. However, due to the various mechanical devices of the dishwasher cooperating to clean, rinse, and dry the dishware in the tub of the dishwasher, such noise reduction generally may be accomplished by analyzing and targeting particular components on an individual basis, such that the overall combined noise produced by the dishwasher is reduced.

In this regard, a conventional dishwasher includes a fill valve through which water is introduced into the tub of the dishwasher for washing the dishware. The fill valve may further serve as a vent through which warm moist air is withdrawn (aided by a lower vent fan) from the tub during an operational cycle of the dishwasher, such as the drying cycle. Typically, the fill valve is located in a side wall of the tub and connects with a water fill tube and an air duct that are integrally formed together as a molded plastic structure. The fill valve often has a single large opening or two or more openings for allowing water or air to pass through.

The fill valve may contribute to the problem of the externally perceptible noise generated by the dishwasher. When water flows through the fill valve into the tub, the flowing water and the splashing of water against the racks and dishware inside the tub generate sound that can be emitted through the openings in the fill valve to the outside environment. Additionally, throughout the entire dishwashing cycle (wash, rinse, sanitize, dry), the openings in the fill valve serve as pathways for the emission of sounds generated by various components and mechanical devices (motor/pump noise, fan noise, etc.).

In some dishwashers, the fill valve includes a valve mechanism configured to selectively open and close the openings of the fill valve. During particular operational cycles, such as the fill cycle and dry cycle, the valve mechanism may open the openings to allow water and/or air to pass through the fill valve. In other cycles, the valve mechanism may close the openings in order to try to minimize noise escaping through the fill valve. Such valve mechanisms add to the cost or complexity of the fill valve. Moreover, the valve mechanism may fail causing the dishwasher to become inoperable. For example, if the valve mechanism fails to open the openings water will be unable to fill the tub during the fill cycle and the moist air will not be able to readily evacuate the tub during the drying cycle.

In view of the foregoing, there is a need to help reduce noise that is transmitted through the fill valve of a dishwasher.

BRIEF SUMMARY

One or more embodiments of a dishwasher are disclosed that help manage the acoustic emissions transmitted through a fluid inlet. For example, according to an embodiment, the dishwasher may comprise a tub, a water conduit, and a fluid inlet in communication with the tub and the water conduit. The fluid inlet includes a nozzle defining a combination of a plurality of relatively small-diameter orifices and a plurality of relatively large-diameter orifices. During a filling cycle of the dishwasher, water is transmitted along the water conduit through the nozzle to the tub. The fluid inlet may be supported by a side wall of the tub.

Each of the relatively large-diameter orifices may define a diverging cross-section in a water inflow direction. The relatively small-diameter orifices may be interspersed in a plurality of clusters between the relative larger diameter orifices, and the relatively small-diameter orifices within each cluster may be according to a particular pattern. According to an embodiment, each cluster includes seven small diameter orifices.

According to another embodiment, the fluid inlet further comprises an enclosure defining a vertically descending channel from the nozzle toward a bottom of the tub. One or more multi-directional variable or fixed dampers may be disposed within the enclosure such that the water exiting the nozzle cascades down onto and over the dampers and out of the enclosures through one or more outlets of the enclosure to the bottom of the tub.

In yet another embodiment, the dishwasher further includes an air conduit extending from an inlet end in communication with the fluid inlet to an outlet end. During an operational cycle of the dishwasher, air is withdrawn from the tub through the fluid inlet and the air conduit and out of the outlet end. The air conduit and the water conduit may be integrally formed.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF THE INVENTION

The present invention or inventions now will be described more fully hereinafter with reference to the accompanying drawings, in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
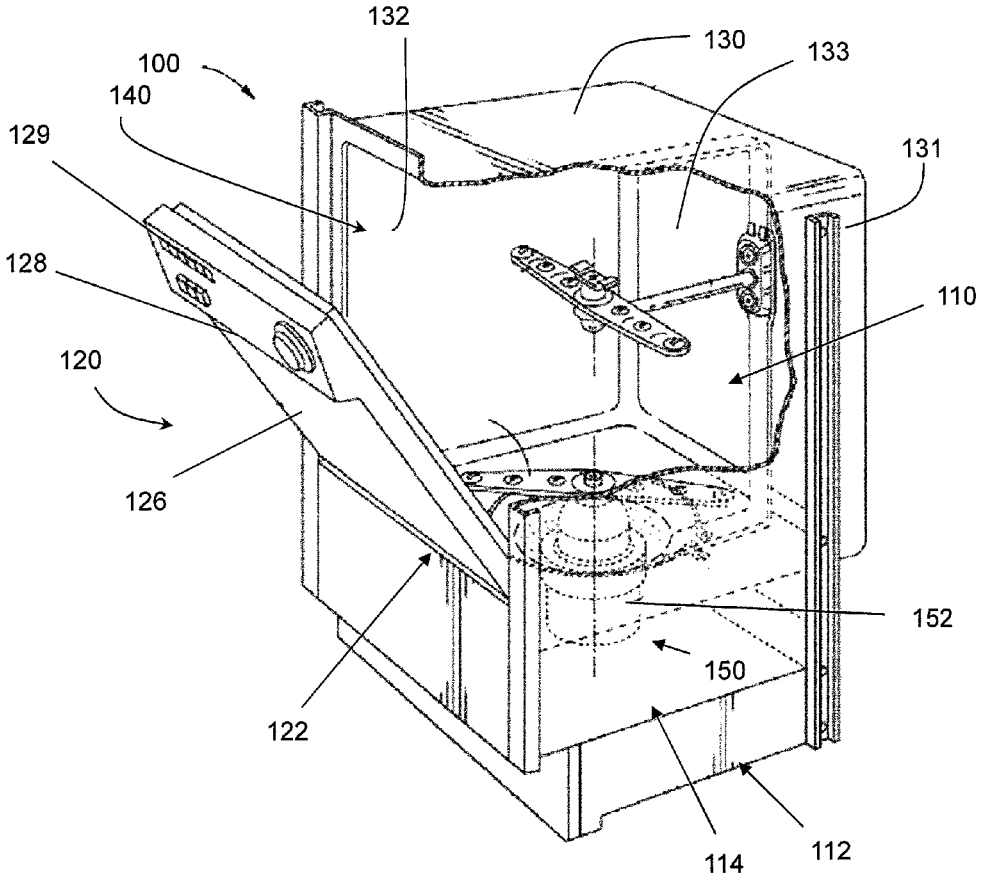
FIG. 1 is a perspective view of a dishwasher of a type suitable for use with various embodiments of the present invention.

FIG. 1 illustrates an example of a dishwasher 100 that may benefit from various embodiments of the present invention. The dishwasher 100 may include a tub 110 (partly broken away in FIG. 1 to show internal details) having a door assembly 120 and a plurality of walls (e.g., a top wall 130, a left side wall 131, a right side wall 132, and a rear wall 133) that together form an enclosure in which dishes, utensils, and other dishware may be placed for washing. The tub 110 may also define a forward access opening 140. As known in the art, the dishwasher 100 may also include slidable lower and upper racks (not shown) for holding the dishes, utensils, and other dishware to be washed. The tub 110 may define a sump 150, in which wash water or rinse water is collected, typically under the influence of gravity. The wash/rinse water may be pumped by a pump 152 out of the sump 150 via a heater to various spray arms 160 mounted in the interior of the tub 110 for spraying the wash/rinse water, under pressure, onto the dishes, utensils, and other dishware contained therein. The pump 152 and/or other operational components (e.g., fans, motors, electrical outlets, valves, etc.) may be housed, disposed, or otherwise positioned within a base 112 positioned beneath the tub 110, wherein the base 112 receives and supports a lower end 114 of the tub 110. In some instances, the base 112 may be a separate component with respect to the tub 110, such as, for example, a formed material or a molded polymer component, while in other instances the base 112 may be integral with the tub 110 such that the side walls forming the tub 110 also at least partially form the base 112.

The door assembly 120 may be pivotably engaged with the tub 110 about the lower end 114 thereof so as to selectively permit access to the interior of the tub 110. That is, a lower edge 122 of the door assembly 120 may be pivotably engaged (e.g., hinged) with the lower end 114 of the tub 110 such that the door assembly 120 is pivotable about the lower edge 122 thereof to cover and seal the forward access opening 140 in a closed position when the dishwasher 100 is in operation and to provide access to the interior of the tub 110 through the forward access opening 140 when the door assembly 120 is pivoted from the closed position to an opened position. In some instances, the door assembly 120 may comprise an inner wall 124 and an outer wall 126. The door assembly 120 may include a handle member 128 disposed on the outer wall 70 to provide the user with a grasp portion.

Figure 2:
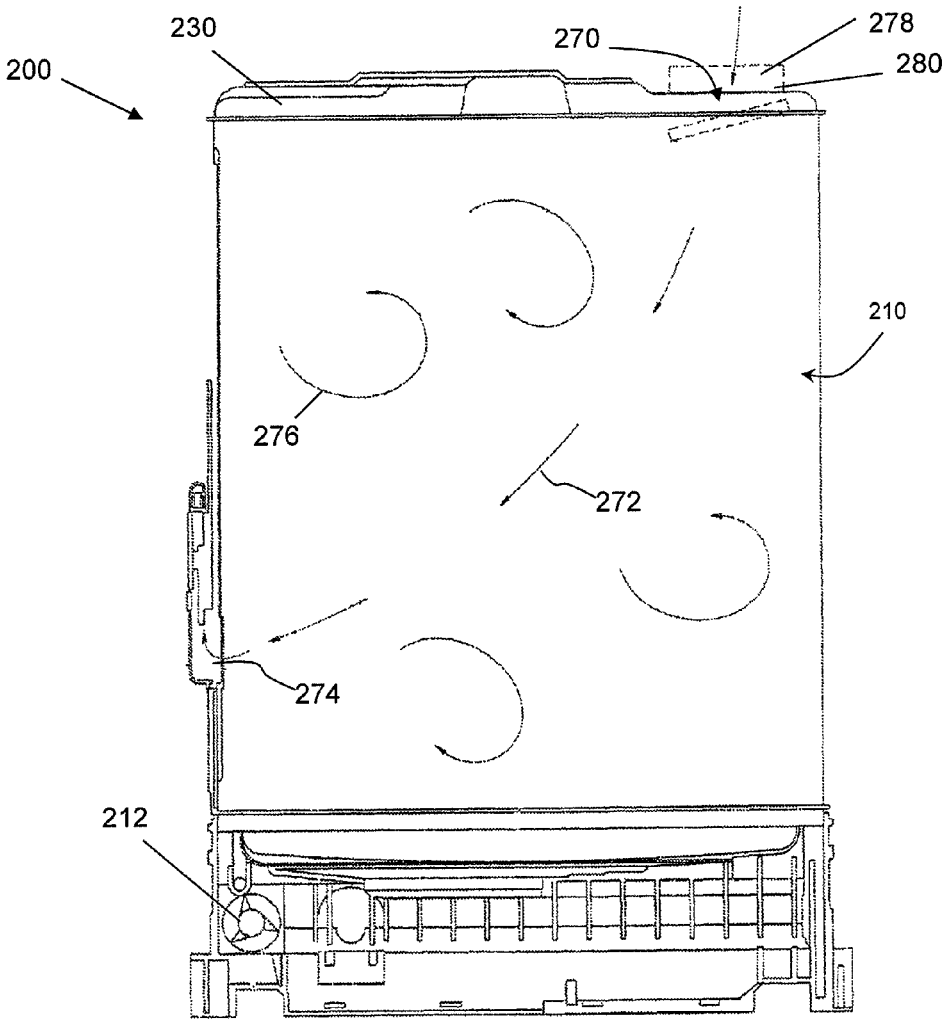
FIG. 2 is a frontal view of a dishwasher similar to the dishwasher of FIG. 1 having a door assembly removed.

FIG. 2 illustrates a front view of a dishwasher 200 with the door assembly removed such that the interior of the tub 210 is visible. One of the walls of the tub, e.g., the top wall 230, may include a passage 270 extending from the interior of the tub to outside the tub or dishwasher to encourage a cross air flow 272 between the passage 270 and a fluid inlet 274 and may also encourage laminar and/or turbulent air flow and/or eddying air currents 276 that will enhance the drying and the sanitizing of the dishware during a drying cycle or a sanitizing cycle of the dishwasher 200.

The passage 270 can be configured to provide fluid communication between the interior of the tub 210 and an area outside of the dishwasher. The dishwasher may further include a valve assembly 278 for selectively opening and closing the passage. For example, a check valve or a flap arrangement in communication with a driver (not illustrated), e.g., a motor, for activating the valve assembly may be used. In addition to or instead of the valve assembly, the dishwasher may further include a fan assembly 280 for encouraging air flow through the interior of the tub 210 during a drying cycle or a sanitizing cycle of the dishwasher 200.

As mentioned above, the dishwasher 200 further includes a fluid inlet 274 for introducing water into the interior of the tub 210 during a filling cycle of the dishwasher 200. In addition to allowing the passage of water, the fluid inlet 274 can be configured to allow passage of air and vapors as well, as discussed above. In other words, the illustrated fluid inlet 274 functions as both an inlet port to add water (or other fluids) during a filling cycle and a vent opening to assist in evacuating warm moist air (or other gases) from the interior of the tub 210 during a drying cycle of the dishwasher 200.

The fluid inlet 274 is in communication with a water conduit 290, e.g., a hose or pipe, extending between the fluid inlet 274 and a water source 292, such as a tap water supply. The water conduit 290 can be connected to the water source 292 by way of a water line 294. A valve 296, e.g., a solenoid valve, may be placed along the water line 294 to allow a controller of the dishwasher to open and close the valve 296 to control the flow of water as the dishwasher 200 performs the various cycles of the dishwashing process.

Figure 3:
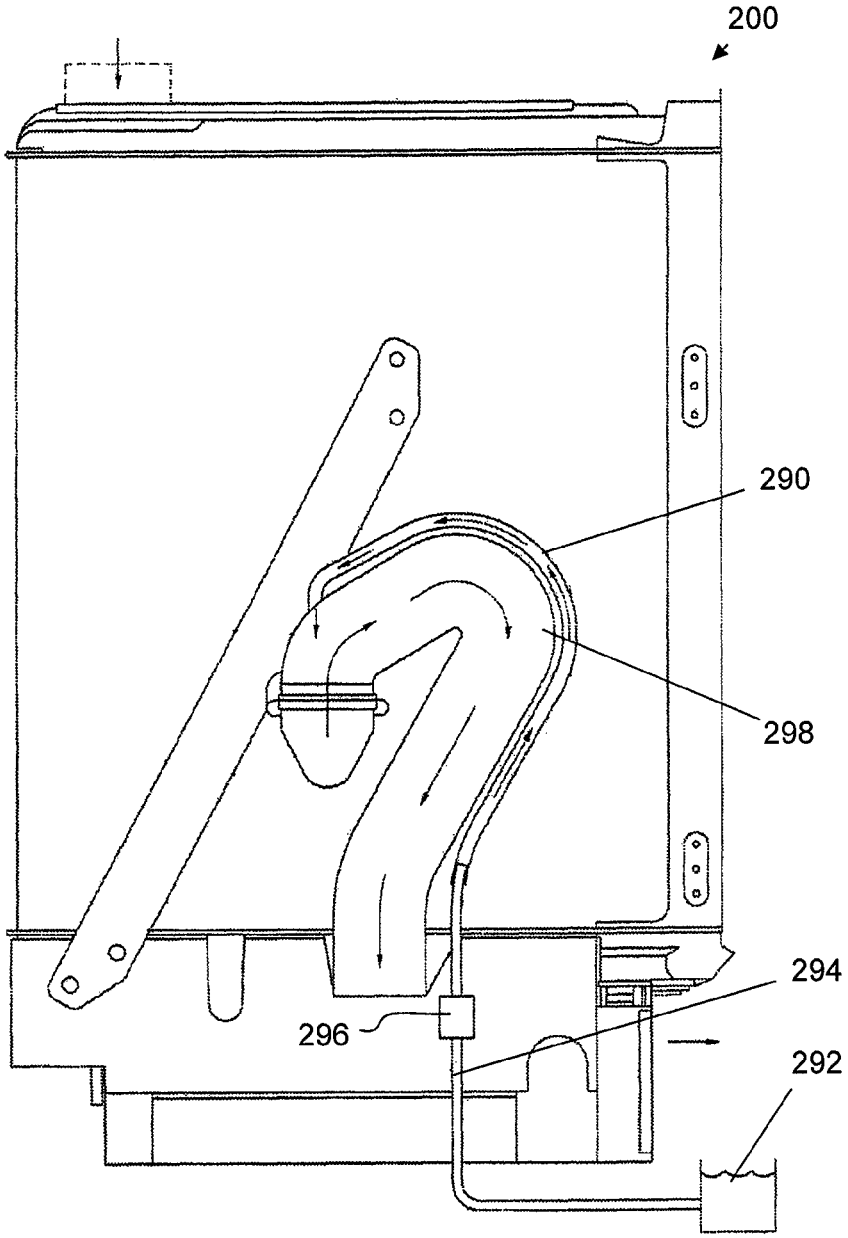
FIG. 3 is a left side view of the dishwasher of FIG. 2.

As illustrated, the dishwasher 200 may further include an air conduit or duct 298 also in communication with the fluid inlet 274. The air conduit 298 extends from a first end or inlet end in communication with the fluid inlet 274 to a second end or outlet end configured to disburse air outside of the tub 210 during the drying cycle. As an example and as illustrated in FIG. 3, the air conduit 298 can have an inverted J-shape to help encourage condensation of any moisture in the escaping air.

The dishwasher may include a fan assembly in communication with the air conduit, e.g., at either end of the air conduit, to encourage air flow through the air conduit. As a specific example and as illustrated, a fan assembly 212 may be positioned near the outlet end of the air conduit and be configured to draw dry air from outside the tub or dishwasher into the air conduit. As explained in more detail further below, as the air travels through the air conduit, the air mixes with the condensed moisture in the air conduit formed during the drying cycle.

In operation, the dishwasher 200 may be activated, e.g., through a user input device on the door assembly as denoted in FIG. 1 with reference number 129, to initiate the dishwashing process. The valve 296 may open to allow water to travel through the water conduit 298 to and through the fluid inlet 274 into a lower area of the tub 210, referred to as a filling cycle. After a predetermined amount of water is introduced, a cleaning cycle may begin. As detergent is introduced, a pump at the bottom of the tub pumps the water up to the spray arms that spray the water over the dishware in the tub to clean the dishware. Eventually, the now dirty water can be drained from the tub and more water may be introduced through the fluid inlet to start a rinse cycle. The wash and rinse cycles can be repeated if desired. After the rinse cycle is complete, the water within the tub may be drained and the drying cycle may be initiated. In some embodiments, one or more heating elements (not shown) may be activated to heat the interior of the tub to encourage evaporation of water from the dishware items. One or more fan assemblies can be activated to encourage the warm moist air through the fluid inlet 274 into the air conduit 298. As the warm moist air is evacuated from the tub, drier air from the outside of the dishwasher may be introduced by way of an air passageway defined in the top wall of the tub as described above to reduce the time necessary to dry the dishware located within the tub.

Figure 4B:
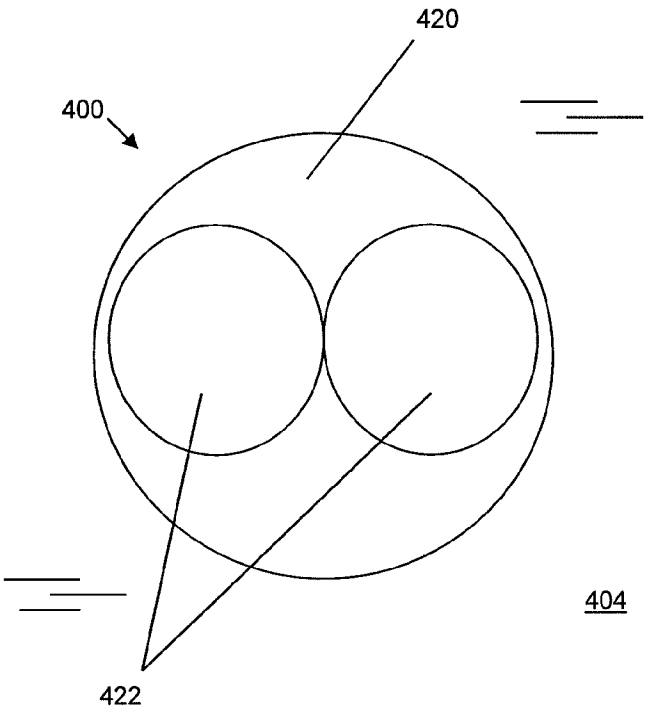
FIG. 4*b* is a frontal view of the fluid inlet of FIG. 4*a*.
Figure 4A:
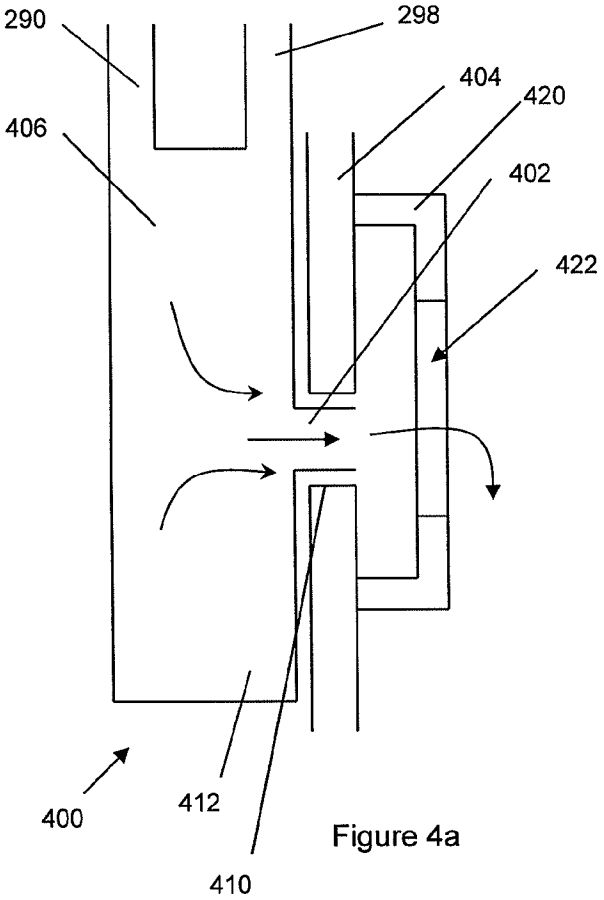
FIG. 4*a* is a cross-sectional view of a fluid inlet.

One or more embodiments of a dishwasher are directed to attenuating acoustic emissions transmitted through a fluid inlet. FIGS. 4*a* and 4*b* illustrate an example of a fluid inlet. The fluid inlet 400 is configured to cooperate with an opening 402 defined in the side wall 404 of the tub. The fluid inlet 400 may include a base 406 that is configured to receive the fluid conduit 290 and the air conduit 298. The base 406 may include an extension portion 410 for extending through the opening 402. The base 406 may also define a cavity or reservoir 412 configured to hold a predetermined amount of water.

The fluid inlet 400 further includes a nozzle 420. The nozzle 420 defines one or more spaced-apart orifices 422 for allowing the passage of water (represented by the arrows in FIGS. 4*a* and 4*b*) and air flow through the nozzle. The nozzle 420 of FIGS. 4*a* and 4*b* has a puck-like shape and is held substantially against an inner surface of the side wall 404 of the tub. However, in other embodiments, the shape of the nozzle may vary. For example, the nozzle may be essentially a two-dimensional surface having a circular shape or having a shape substantially matching the shape of the opening.

In the illustrated embodiment, the nozzle is secured in place through the extension portion of the base. However in other embodiments, the nozzle may be secured directly to the side wall of the tube. As examples, the nozzle may be secured to the side wall with an adhesive, one or more fasteners, or may be molded or formed to the side wall. Moreover, in some embodiments, the fluid inlet may not include a base, e.g., the nozzle may be in direct communications with the fluid and water conduits via the opening in the side walls and without a base.

Figure 6:
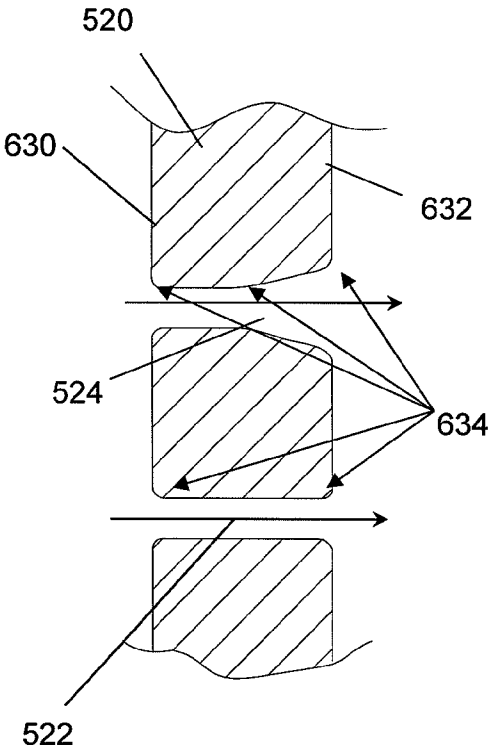
FIG. 6 is a partial cross-sectional view of the nozzle of FIG. 5 taken along the FIG. 6 line in FIG. 5.
Figure 5:
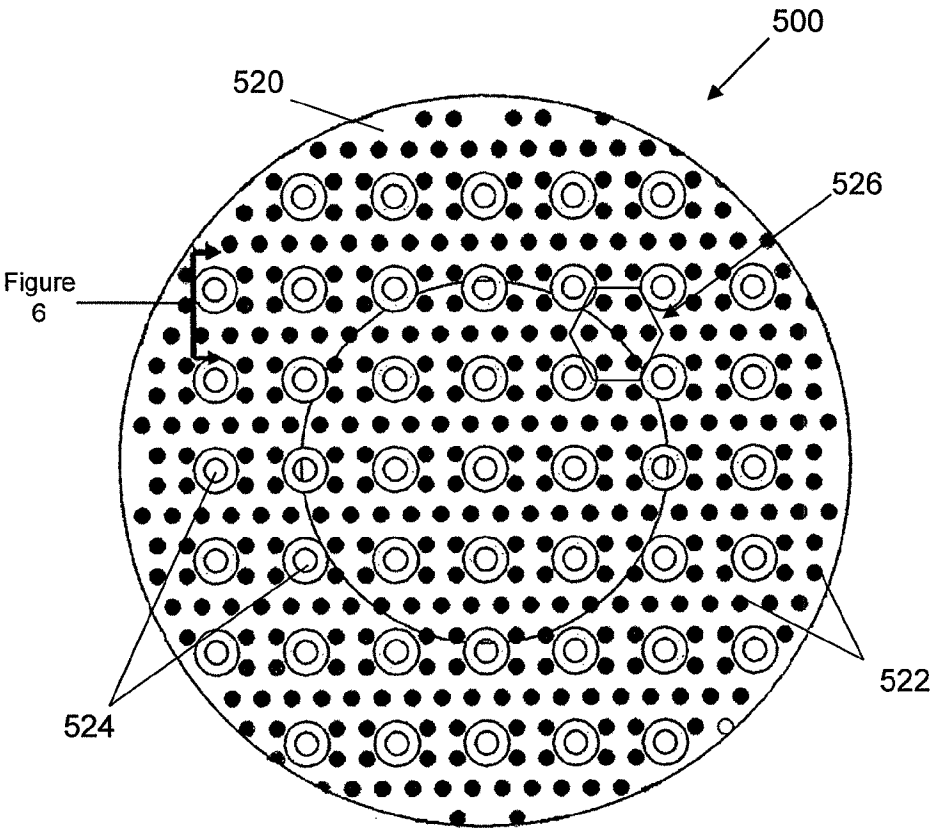
FIG. 5 is a frontal view of a nozzle of a fluid inlet according to an embodiment.

In accordance with another embodiment and as illustrated in FIGS. 5 and 6, a fluid inlet 500 is provided. The fluid inlet 500 includes a nozzle 520 defining a plurality of orifices 522, 524. The relative sizes and shapes of the orifices 522, 524 may be configured to reduce or manage the acoustic emissions transmitted through or by the nozzle 520. As explained above, the sources of the acoustic emissions may vary internally and externally, e.g., the splashing and transmission of water and the pumps, motors, valves, and other components of the dishwasher and devices and the environment external of the dishwasher. According to the illustrated embodiment of FIGS. 5 and 6, the nozzle 520 defines a combination of a plurality of relatively small-diameter orifices 522 interspersed with a plurality of relatively large-diameter orifices 524. For example, the nozzle 520 may define a plurality of clusters 526 of small-diameter orifices between the large-diameter orifices 524. As a more specific example and as illustrated, the nozzle 520 may define clusters of up to seven small-diameter orifices 522 between four large-diameter orifices 524. The small-diameter orifices 524 in each cluster 526 may be arranged according to a particular pattern, e.g., a hexagonal pattern or a pentagonal pattern. Water is discharged through the relatively small and large orifices into the tub. Also, as explained above, the fluid inlet may also function as vent such that air may travel through the relatively small and large orifices into and out of the tub. "Relatively" as used in reference to the orifices describes the relative sizes of the different size holes to each other, i.e., the orifices of the first plurality of orifices are smaller than the orifices of the second plurality of orifices and thus are referred to herein as relatively small-diameter orifices. Likewise, the orifices of the second plurality of orifices are referred to herein as relatively large-diameter orifices because the orifices of the second plurality are larger than the orifices of the first plurality.

As shown in FIG. 6, according to this embodiment, the relative small-diameter orifices 522 have a constant cross-section, i.e., the diameter of the orifice remains the same along the length of the orifice from an inner surface 630 (facing away from the tub) of the nozzle to an outer surface 632 (facing toward the tub) of the nozzle. As an example the diameter of a relatively small-diameter orifice may be approximately 0.5 mm. The relative large-diameter orifices 524 have a diverging cross-section in the water inflow direction. More specifically, the diameter of a large-diameter orifice increases from the inner surface 630 of the nozzle to the outer surface 632 of the nozzle over at least a portion of the distance between the inner and outer surfaces 630, 632 of the nozzle. As an example, the diameter of the relatively large-diameter orifice may range from approximately 1.5 mm at its largest point and approximately 0.5 mm at its smallest point. In other embodiments, the relatively large-diameter orifices may have a constant cross-section. The size of the diameters may vary depending on the sound power level and frequency requirements. In general, the diameter of the small-diameter orifices may decrease to target higher frequencies and the diameter of the larger-diameter orifices may increase to target lower frequencies.

As illustrated in FIG. 6, the corners 634 defined between the orifices and the material of nozzle may be rounded, e.g., beveled, in order to minimize flow jetties or turbulence from the air or water travelling through the orifices. Minimizing the flow jetties and turbulences helps to reduce sound power level concentrations and sound wave amplitudes.

Figure 8:
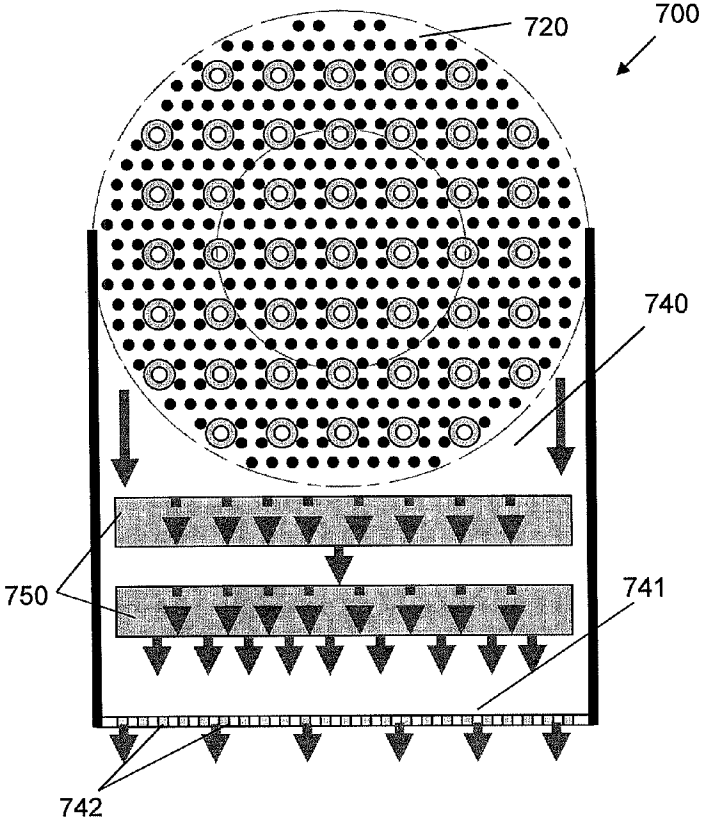
FIG. 8 is a schematic front cross-sectional view of the fluid inlet of FIG. 7.
Figure 7:
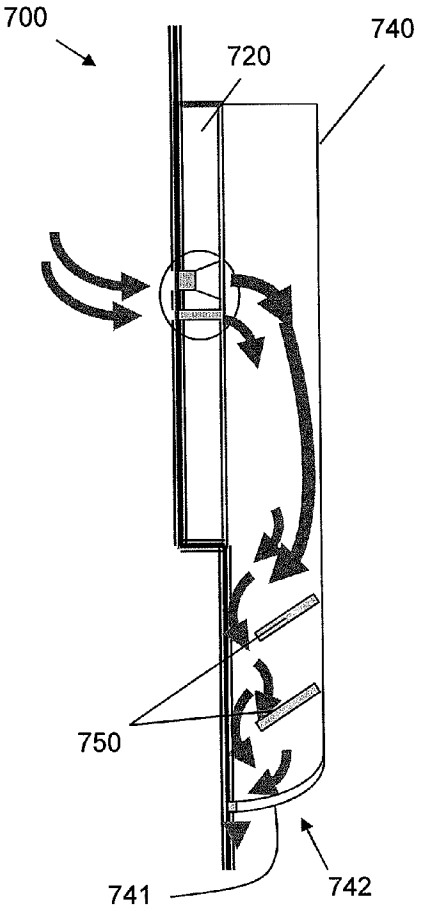
FIG. 7 is a schematic side cross-sectional view of a fluid inlet according to another embodiment.
Figure 12:
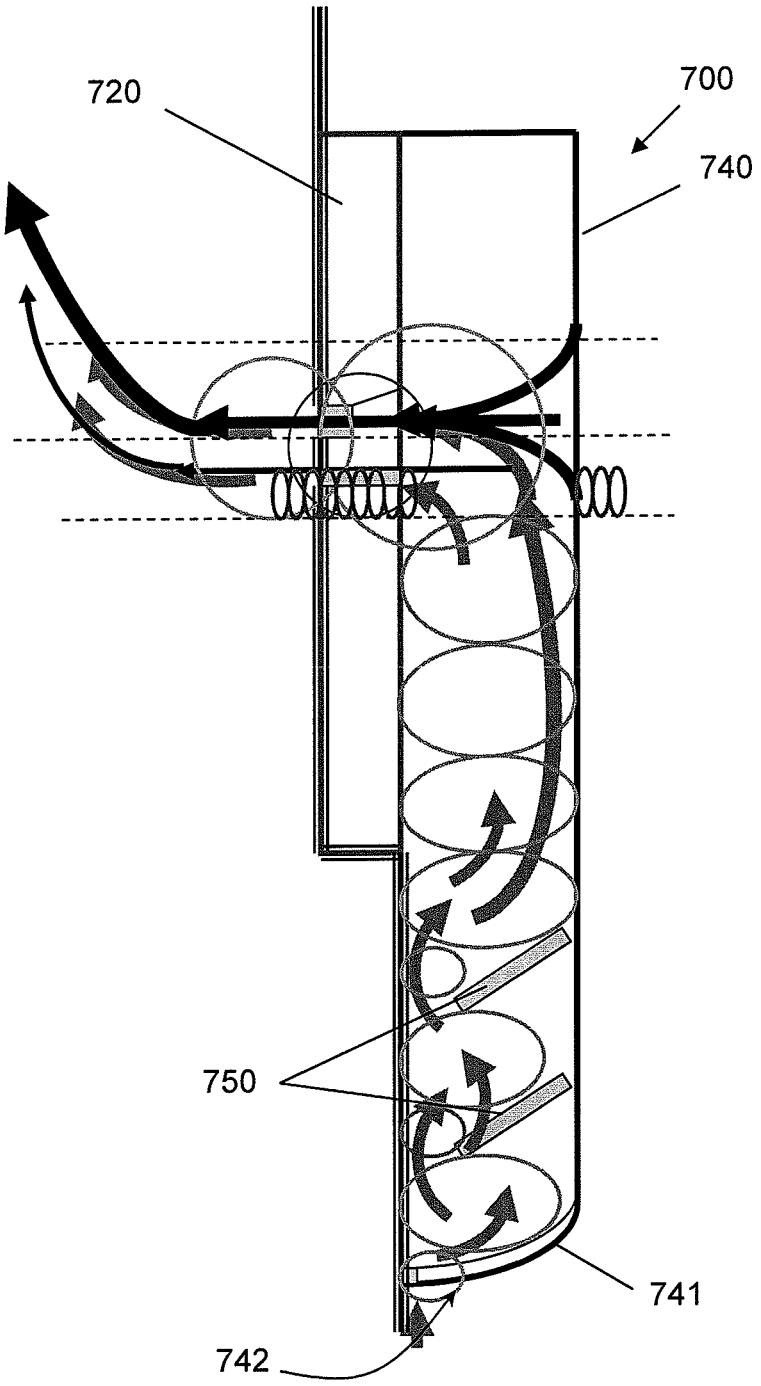
FIG. 12 is another schematic illustration of high and lower frequency sound waves reflected back through the fluid inlet.

According to the embodiment illustrated in FIGS. 7 and 8, the fluid inlet 700 may further include an enclosure 740 and one or more dampers or baffles 750. The enclosure 740 generally extends from the nozzle 720 to near the bottom of the tub defining a vertically descending and ascending channel. The dampers 750 are disposed within the channel and are vertically spaced-apart from one another. The enclosure 740 and the dampers 750 are configured such that the water exiting the nozzle 720 cascades down onto and over the dampers 750 and out of the enclosure through one or more outlet ports 742 extending through a bottom wall 741 of the enclosure into the tub. Therefore the water exits the enclosure near the bottom of the tub. The arrows illustrated in FIGS. 7 and 8 represent the water flow from the water conduit (which may be integrally formed with the air conduct and collectively referred to in the art as the "dry duct") through the fluid inlet 700 of this illustrated embodiment and out to the tub of the dishwasher. The arrows illustrated in FIG. 12 represent air (or gas) cascading up and around the dampers 550 from the bottom of the tub to the nozzle 720.

Figure 13:
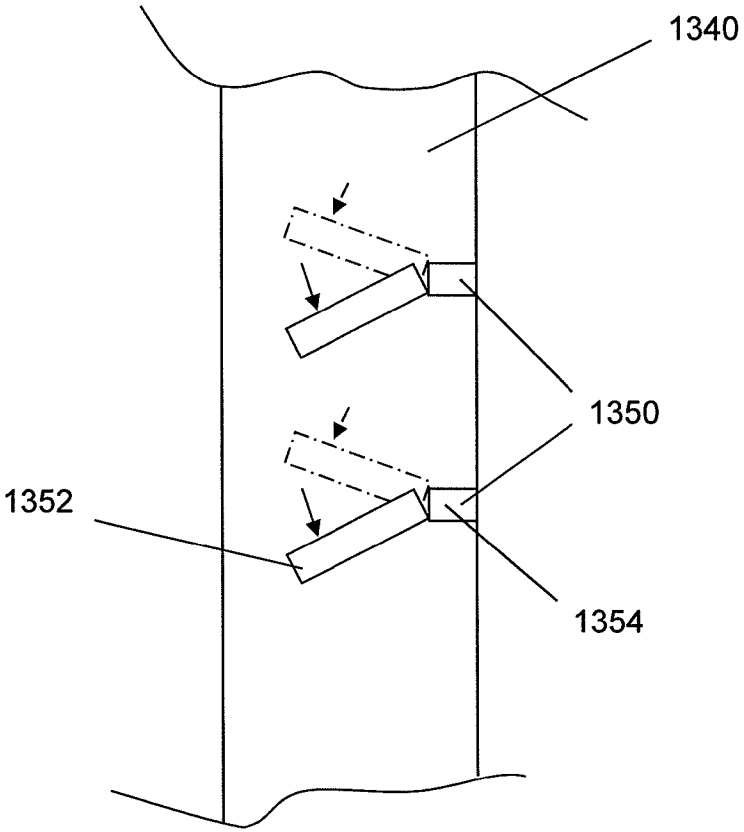
FIG. 13 is a cross-section view of an enclosure and variable dampers of a fluid inlet according to yet another embodiment.

One or more of the dampers may be fixed or movable, also referred to as a "variable damper." In general, a fixed damper is configured to withstand the forces of the air or water moving through the enclosure such that the fixed damper does not change position or orientation regardless of the direction of the air or water. As illustrated in FIG. 13, a variable damper 1350 is configured to at least partially move or otherwise change orientation relative to the enclosure 1340. For example and as illustrated, the variable damper 1350 may include a movable portion 1352, such as an unsupported end, and a fixed portion 1354. As indicated with the arrows in FIG. 13, the flow of the water or air may create enough force on the movable portion 1352 to alter the orientation of the movable portion 1352. Therefore, in such embodiments, the orientation of the variable dampers 1350 may depend of the direction of flow of the water or air.

Figure 10:
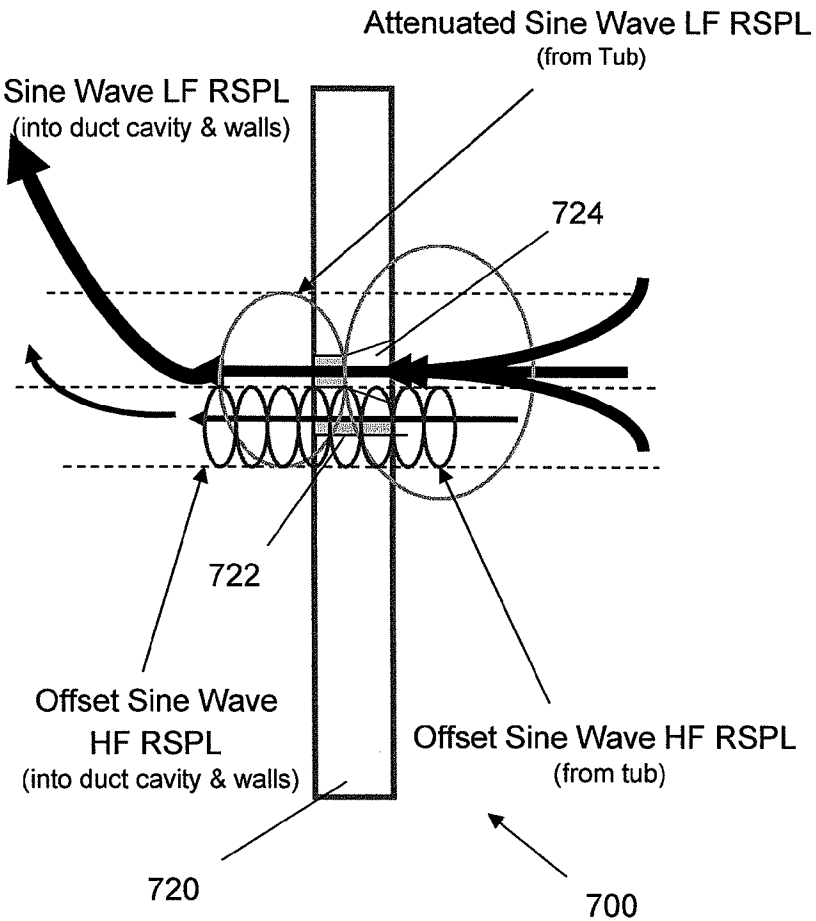
FIG. 10 is a schematic illustration of high and lower frequency sound waves reflected back through the fluid inlet.
Figure 9:
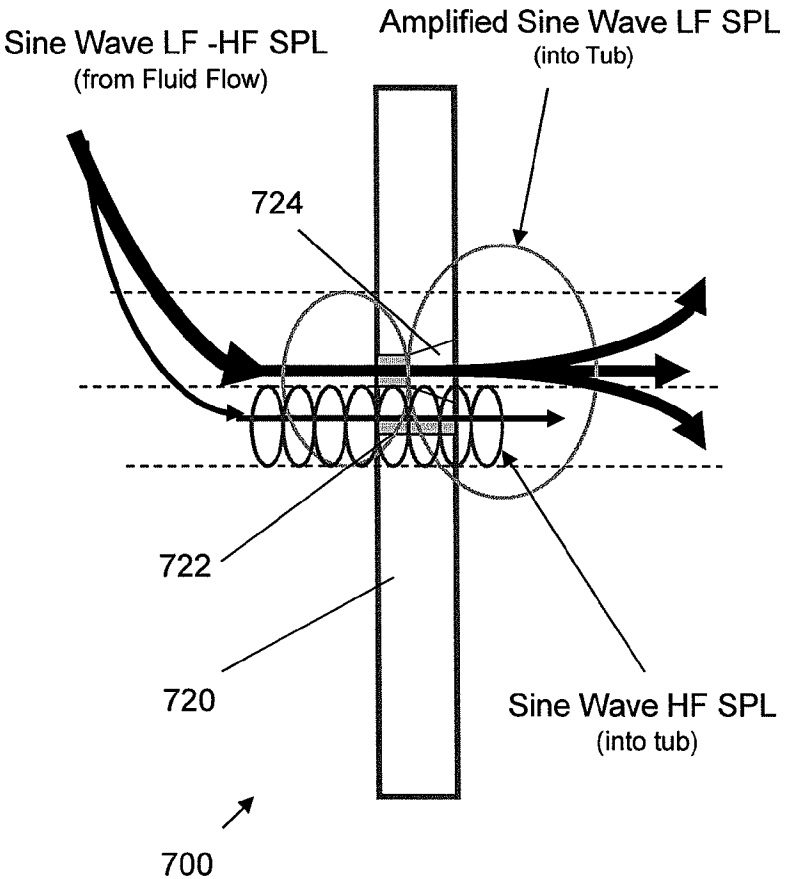
FIG. 9 is a schematic illustration of high and low frequency sound waves created or associated with the flow of water pass through the fluid inlet.
Figure 11:
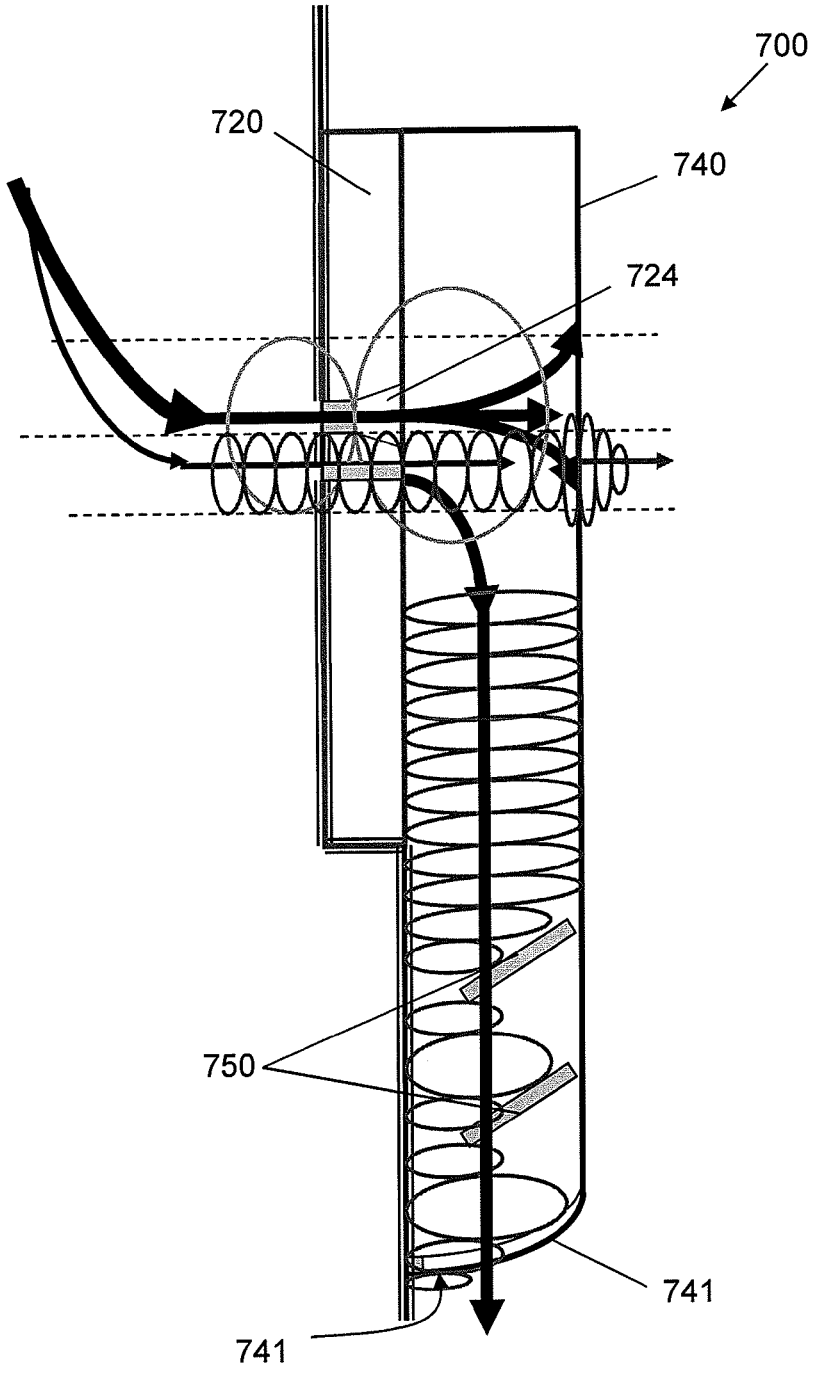
FIG. 11 is another schematic illustration of high and lower frequency sound waves created or associated with the flow of water passing through the fluid inlet.

It is believed that the embodiments of the fluid inlet help to manage the transmission of sound. For example and while not intending to be bound by any particular theory, FIGS. 9-12 provide schematic illustrations on how the fluid inlet 700 is configured to manage the transmission of sound. More specifically, the transmission of the water creates low and high frequency sound or sound waves. Although a portion of the sound may be reflected, refracted, or absorbed along the way, a significant amount of the sound is likely to travel along the same transmission path as the water, i.e., the water conduit and the fluid inlet. Similarly, the sound created from the transmission of air back to the nozzle is most likely to travel along the same transmission path as the air. FIGS. 9 and 11 are schematic illustrations of high and low frequency sound waves (reference in the figures as the "Sine Wave LF-HF SPL" (sound power level)) created by or associated with the flow of water passing through the fluid inlet 700 including the nozzle 720. The relative small orifices 722 are configured to allow the high frequency sound waves to pass through to the tub. The relative large orifices 724 are configured to allow the low frequency sound waves to pass through to the tub. Moreover, the diverging shape of a relative large orifice amplifies 724 the low frequency sound waves as the sound waves enter the tub.

The sound waves entering the tub generally may be refracted, reflected, and absorbed in the tub. A portion of the sound waves are reflected back through the fluid inlet. FIGS. 10 and 12 are a schematic illustration of the high and low frequency sound waves reflected back and through the fluid inlet (reference in the figures as the "Sin Wave HF RSPL" and "Sin Wave FL RSPL"). Due to the orientation of the diverging relative large orifices, the high frequency sound waves are attenuated. The attenuated high frequency sound waves enter into the dry duct where the sound waves are further reflected, refracted, and/or absorbed by the walls of the duct or other sound attenuating structures. The reflected low frequency sound waves transmit from the tub through the relatively small-diameter orifices into the dry duct where the sound waves are further reflected, refracted, and/or absorbed by the walls of the dry duct or other sound attenuating structures. The reflected low frequency sound waves may be offset relative to the low frequency sound waves. The travel of the sound waves is bi-directional, i.e., sound waves are travelling toward the tub (referred to as "inbound sound waves" and sound waves are travelling away from the tub ("outbound sound waves"). The inbound low and high frequency sound waves converge with the outbound low and high frequency sound wavers moving across the fluid inlet. The converging sound waves are off phase and destructive to each other causing a lower sound power level emitting from the fluid inlet to outside the dishwasher.

In some embodiments, a fluid inlet as described herein may be used to retrofit or modify existing dishwashers. For example, a nozzle having the combination of relative large and small diameter orifices or holes can be used to replace an existing nozzle having only a plurality of holes or openings having the same diameter.

One or more embodiments of the dishwasher disclosed herein allow for the management of acoustic emissions through the geometry of the orifices defined in the fluid inlet without having a valve mechanism to selectively open and close the orifices. By using the geometry of the orifices to manage the acoustic emissions rather than a valve mechanism, the fluid inlet of some of the embodiments may be less prone to defects, such as those associated with a valve mechanism, and less expensive to manufacture.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A fluid inlet for a dishwasher comprising:

a nozzle comprising a combination of a first plurality of orifices and a second plurality of orifices, at least one of the second plurality of orifices defining a diverging cross-section in a water inflow direction, the diverging cross-section defining a first diameter and a second diameter, wherein each of the first diameter and the second diameter are larger than a diameter of each of the first plurality of orifices, wherein the first plurality of orifices each define a diameter that is constant along a length of the orifice, wherein the first plurality of orifices and the second plurality of orifices are configured to manage sound transmitted through the fluid inlet so as to reduce noise during a filling cycle of the dishwasher.

2. The fluid inlet according to claim 1, wherein the first plurality of orifices are interspersed in a plurality of clusters between the second plurality of orifices.

3. The fluid inlet according to claim 2, wherein each cluster includes seven of the first plurality of orifices disposed between four of the second plurality of orifices.

4. The fluid inlet according to claim 2, wherein each cluster is arranged in a hexagonal pattern.

5. The fluid inlet according to claim 1 further comprising an enclosure defining a vertically descending channel from the nozzle.

6. The fluid inlet according to claim 5 further comprising one or more dampers within the enclosure.

7. The fluid inlet according to claim 6, wherein at least one of the one or more dampers is at least partially movable depending on a direction of flow of air or water traveling through the enclosure.

8. The fluid inlet according to claim 1, wherein each of the second plurality of orifices defines a diverging cross section.

9. The fluid inlet according to claim 8, wherein each of the first plurality of orifices defines a constant cross section.

10. The fluid inlet according to claim 1, wherein each of the first and second plurality of orifices defines a diverging cross section.

11. The fluid inlet according to claim 1, wherein at least one of the second plurality of orifices defines a diverging cross-section in the water inflow direction.

12. A fluid inlet for a dishwasher comprising:

a nozzle comprising a combination of a first plurality of orifices and a second plurality of orifices, each of the second plurality of orifices having a larger diameter than each of the first plurality of orifices, wherein each of the first plurality of orifices define a constant cross-section, and wherein each of the second plurality of orifices define a diverging cross-section in a water inflow direction.

13. The fluid inlet according to claim 12, wherein the first plurality of orifices are interspersed in a plurality of clusters between the second plurality of orifices.

14. The fluid inlet according to claim 13, wherein each cluster is arranged in a hexagonal pattern.

15. The fluid inlet according to claim 12 further comprising an enclosure defining a vertically descending channel from the nozzle.

16. The fluid inlet according to claim 15 further comprising one or more dampers within the enclosure.

17. The fluid inlet according to claim 16, wherein at least one of the one or more dampers is at least partially movable depending on a direction of flow of air or water traveling through the enclosure.

18. The fluid inlet according to claim 12, wherein the first and second plurality of orifices are configured to manage sound transmitted through the fluid inlet so as to reduce noise during a filling cycle of the dishwasher.

19. A fluid inlet for a dishwasher comprising:

a nozzle comprising a combination of a first plurality of orifices and a second plurality of orifices, each of the second plurality of orifices having a larger diameter than each of the first plurality of orifices, wherein at least one of the first plurality of orifices or at least one of the second plurality of orifices defines a diverging cross-section in a water inflow direction;

an enclosure defining a vertically descending channel from the nozzle; and one or more dampers within the enclosure, wherein at least one of the one or more dampers is at least partially movable depending on a direction of flow of air or water traveling through the enclosure.

20. The fluid inlet according to claim 19, wherein the first and second plurality of orifices are configured to manage sound transmitted through the fluid inlet so as to reduce noise during a filling cycle of the dishwasher.

21. The fluid inlet according to claim 19, wherein the first plurality of orifices are interspersed in a plurality of clusters between the second plurality of orifices.

* * * * *